US011805957B2

(12) United States Patent
Jupp et al.

(10) Patent No.: US 11,805,957 B2
(45) Date of Patent: Nov. 7, 2023

(54) FLOOR CLEANING APPARATUS AND LIQUID DELIVERY ASSEMBLY FOR USE IN FLOOR CLEANING APPARATUS

(71) Applicant: Hayco Manufacturing Limited, Hong Kong (HK)

(72) Inventors: Simeon Jupp, Hong Kong (HK); Kin Wong Yau, Hong Kong (HK); Hoss Vong, Hong Kong (HK)

(73) Assignee: Hayco Manufacturing Limited, Hong Hong (HK)

( * ) Notice: Subject to any disclaimer, the term of this patent is extended or adjusted under 35 U.S.C. 154(b) by 193 days.

(21) Appl. No.: 17/347,478

(22) Filed: Jun. 14, 2021

(65) Prior Publication Data

US 2022/0039628 A1 Feb. 10, 2022

(30) Foreign Application Priority Data

Aug. 5, 2020 (GB) ..... 2012186

(51) Int. Cl.
*A47L 13/22* (2006.01)
*A47L 11/40* (2006.01)

(52) U.S. Cl.
CPC ..... *A47L 13/22* (2013.01); *A47L 11/4083* (2013.01); *A47L 11/4088* (2013.01)

(58) Field of Classification Search
CPC .. A47L 13/22; A47L 11/4088; A47L 11/4083; A47L 11/408
See application file for complete search history.

(56) References Cited

U.S. PATENT DOCUMENTS

2002/0168216 A1* 11/2002 Policicchio ..... B08B 1/00 401/138
2004/0134016 A1* 7/2004 Kisela ..... A47L 9/2842 15/403
2006/0233593 A1* 10/2006 Tanaka ..... A47L 13/22 401/137
2009/0252546 A1 10/2009 Kaleta et al.
2012/0093563 A1* 4/2012 Ganeson ..... A47L 13/22 401/25
2012/0315166 A1* 12/2012 Looi ..... F04B 45/047 417/539
2013/0017110 A1* 1/2013 Villagomez ..... F04B 43/026 417/559

(Continued)

FOREIGN PATENT DOCUMENTS

GB 2471972 A 1/2011
WO 2004062457 A 7/2004
WO 2017190212 A1 11/2017

*Primary Examiner* — Patrick M. Buechner
(74) *Attorney, Agent, or Firm* — Melvin Li

(57) ABSTRACT

There is disclosed a floor cleaning apparatus. The apparatus has a cleaning head portion for engaging a floor surface during cleaning, an upstanding portion for maneuvering movement of said cleaning head portion, a liquid delivery assembly, a handle portion extending from said upstanding portion and a sealed liquid storage container. The cleaning head portion includes a first nozzle and a second nozzle arranged on lateral opposite ends for forward discharging of cleaning detergent therefrom. The liquid delivery assembly is configured to prevent, or at least minimize, undesirable leaking from the nozzles regardless of the orientation of the apparatus or the assembly.

18 Claims, 14 Drawing Sheets

(56) References Cited

U.S. PATENT DOCUMENTS

| | | | | |
|---|---|---|---|---|
| 2015/0337820 | A1* | 11/2015 | Cai | F04B 53/14 417/375 |
| 2017/0135531 | A1* | 5/2017 | Mak | F04B 43/0045 |
| 2019/0145387 | A1 | 5/2019 | Schoenmeyr et al. | |
| 2019/0365190 | A1* | 12/2019 | McDonnell | A47L 13/254 |

* cited by examiner

--Prior Art--

--Prior Art--

FLOOR CLEANING APPARATUS AND LIQUID DELIVERY ASSEMBLY FOR USE IN FLOOR CLEANING APPARATUS

CROSS REFERENCE TO RELATED APPLICATION

This application claims priority from earlier file UK Patent Application No. 2012186.9 filed Aug. 5, 2020, contents of which are incorporated herein in their entirety.

FIELD OF THE INVENTION

The present invention is concerned with a floor cleaning apparatus and a liquid delivery assembly suitable for, but not limited to, use in a floor cleaning apparatus. The present invention is also concerned with different applications of liquid delivery assemblies.

BACKGROUND OF THE INVENTION

There are a variety of conventional floor cleaning apparatus. In older generations of such apparatus, the apparatus would typically provide a cleaning head with a stick handle connected to the cleaning head. The cleaning head is configured to be installed with a disposable cleaning fabric sheet for engaging a floor surface during cleaning. If a user would like to make use of a liquid detergent to assist the cleaning, s/he would need to use a separate detergent bottle and spray liquid detergent on the floor surface before cleaning the floor with the apparatus. This can be cumbersome.

Subsequent floor cleaning apparatus have been developed in that there is provided with a cleaning fluid container as part of the apparatus. This type of apparatus is provided with, for example, a switch or actuator on the handle such that on pressing of the switch or the actuator, cleaning fluid from the container can be deployed and sprayed onto a floor surface in front of the apparatus. With such an apparatus, a separate detergent bottle would not be needed. While the provision of a built-in fluid detergent supply unit is desirable, problems of detergent leakage tend to arise at the same time. Other problems include unreliable flow of liquid detergent when desired, complications and/or bulkiness of construction, high manufacture cost, etc.

The present invention seeks to address these problems, and/or at least to provide a useful alternative to the public. The present invention also provides liquid delivery assemblies in general suitable for use in different applications.

SUMMARY OF THE INVENTION

According to a first aspect of the present invention, there is provided a floor cleaning apparatus comprising a cleaning head portion for engaging a floor surface during cleaning, an upstanding portion for maneuvering movement of said cleaning head portion, a liquid delivery assembly, a handle portion extending from said upstanding portion and a sealed liquid storage container, wherein said cleaning head portion includes a first nozzle and a second nozzle arranged on lateral opposite ends for forward discharging of cleaning detergent therefrom, wherein said liquid delivery assembly includes:

- a first chamber,
- a first pipeline allowing fluid communication between said sealed liquid storage container and said first chamber,
- a second chamber situated adjacent said first chamber,

- a first conduit allowing liquid to exit from said second chamber to said first nozzle for discharge,
- a third chamber situated adjacent said first chamber,
- a second pipeline allowing gaseous communication between said third chamber and said sealed liquid storage container,
- an inlet allowing surrounding air or gas to enter said third chamber and then said liquid storage container,
- a fourth chamber situated adjacent said first chamber, and
- a second conduit allowing liquid to exit from said fourth chamber to said second nozzle for discharge, wherein:

a. said first chamber is provided with a first aperture for fluid communication with said second chamber, said first aperture is reciprocatingly closable by a first one-way valve, b. said first chamber is provided with a second aperture for fluid communication with said fourth chamber, wherein said second aperture is reciprocatingly closable by a second one-way valve, and c. said second chamber and said fourth chamber are provided with a third one-way valve and a fourth one-way valve, respectively, for separately controlling flow of liquid to said first conduit and said second conduit, respectively.

With this configuration, undesirable leakage of fluid from said first nozzle or second nozzle is minimized if not prevented altogether.

Preferably, said second chamber and said fourth chamber may be provided with a first spring-loaded valve and a second spring-loaded valve, respectively, for minimizing liquid leakage from said first conduit and said second conduit, respectively.

Suitably, said second chamber and said fourth chamber may be provided with a first plunger and a second plunger, respectively, operable by one motor for pumping fluid from said sealed liquid container to said first and second nozzles, respectively, for discharge.

Advantageously, said third chamber may be provided with a third plunger operable by said one motor for pumping surrounding air or gas via said inlet to said third chamber and then via said second pipeline to said sealed liquid storage container for equalizing pressure in said sealed liquid container.

In an embodiment, said third chamber may be provided with a fifth one-way valve for controlling entry of surrounding air or gas to said third chamber, and a sixth one-way value for controlling passage of the air or gas from said third chamber to said sealed liquid storage container, for equalizing pressure in the liquid storage container.

In one embodiment, said liquid delivery assembly may include a fifth chamber housing said first, second and third plungers and said one motor, and said fifth chamber includes a movable plate drivenable by said one motor and for actuating on said first, second and third plungers alternatingly, thus generating a pumping action.

Advantageously, said cleaning head portion may be free of any check valve for controlling leakage of liquid from said first nozzle and/or said second nozzle when said floor cleaning apparatus is not in use.

According to a second aspect of the present invention, there is provided a liquid delivery assembly for controlling flow of liquid from a sealed liquid storage container to a first nozzle, comprising:

- a first chamber,
- a first pipeline allowing fluid communication between the sealed liquid storage container and said first chamber, a second chamber situated adjacent said first chamber, a first conduit allowing liquid to exit from said second chamber for the first nozzle for discharge, a third chamber situated adjacent said first chamber, a second pipeline allowing gaseous communication between said third chamber and the sealed liquid storage container, and an inlet allowing surrounding air or gas to enter said third chamber and then the liquid storage container, wherein:

a. said first chamber is provided with a first aperture allowing fluid communication with said second chamber, and said first aperture is reciprocatingly closable by a first one-way valve, b. said second chamber is provided with a second aperture reciprocatingly closable by a second one-way valve for controlling flow of fluid to said first conduit for the first nozzle, c. said second chamber is provided with a first plunger operable by one motor for pumping fluid from the sealed liquid storage container via said first pipeline to said first chamber, then via said first aperture to said second chamber, then via said second aperture to said first conduit, and d. said third chamber is provided with a second plunger operable by said one motor for pumping surrounding air or gas via said inlet to said third chamber, and then via said second pipeline to the sealed liquid storage container for equalizing pressure in the sealed liquid container.

With this configuration, only one motor is needed to actively operate both the liquid communication system and the air/gas communication system in the assembly, such that the assembly can be made to be more compact.

Preferably, said second chamber may be provided with a third aperture reciprocatingly closable by a first spring-loaded valve for minimizing liquid leakage from said first conduit.

Suitably, said third chamber may be provided with a third one-way valve for controlling entry of surrounding air or gas to said third chamber, and a fourth one-way value for controlling passage of air or gas from said third chamber to the sealed liquid storage container, for equalizing pressure in the liquid storage container.

Advantageously, said assembly may comprise:

a fourth chamber situated adjacent said first chamber, and a second conduit allowing liquid to exit from said fourth chamber for a second conduit for a second nozzle, wherein:

a. said first chamber is provided with a fourth aperture allowing fluid communication with said fourth chamber, and said fourth aperture is reciprocatingly closable by a fifth one-way valve, b. said fourth chamber is provided with a fifth aperture reciprocatingly closable by a sixth one-way valve for controlling flow of fluid to the second conduit c. said fourth chamber is provided with a second sub-chamber extended therefrom, and said second sub-chamber is provided with a sixth aperture closable by a second spring-loaded valve for minimizing liquid leakage from said second conduit, and d. said fourth chamber is provided with a third plunger operable by said one motor for pumping fluid from the liquid storage container via said first pipeline to said first chamber for the second conduit.

In an embodiment, said assembly may comprise a fifth chamber housing said first, second and third plungers and said one motor, said fifth chamber may include a pivotable plate drivenable by said one motor and for actuating on said first, second and third plungers alternatingly, for generating a pumping action.

In one embodiment, said first and fifth one-way valves may be configured to allow one-way fluid flow from said first chamber to said second chamber and said first chamber to said fourth chamber, respectively.

According to a third aspect of the present invention, there is provided a floor cleaning apparatus comprising a cleaning head portion for engaging a floor surface during cleaning, an upstanding portion for maneuvering movement of said cleaning head portion, a liquid delivery assembly as described above, a handle portion extending from said upstanding portion, and said sealed liquid container, wherein said cleaning head portion includes said first nozzle and said second nozzle arranged on lateral opposite ends for forward discharging cleaning detergent therefrom.

Preferably, in said floor cleaning apparatus, sequentially, said sealed liquid storage container, said first pipeline, said first chamber, said second chamber, said first conduit, and said first nozzle together may define a first liquid flow path.

Suitably, in said floor cleaning apparatus, sequentially, said sealed liquid storage container, said first pipeline, said first chamber, said fourth chamber, said second conduit, and said second nozzle together may define a second liquid flow path.

Advantageously, in said floor cleaning apparatus, sequentially, surrounding air or gas, said inlet, said third chamber, said second pipeline and said sealed liquid storage container together may define a gas flow path.

In a preferred embodiment, wherein said cleaning head portion may be free of any check valve for controlling leakage of liquid from said first nozzle when said floor cleaning apparatus is not in use.

According to a fourth aspect of the present invention, there is provided a liquid processing assembly for controlling flow of a first liquid from a first liquid storage container and controlling flow of a second liquid from a second liquid storage container for discharge, and for mixing said first fluid and said second fluids for generating a formulation therefrom during discharge, comprising:

a first chamber, a first pipeline allowing fluid communication between the first liquid storage container and said first chamber, a second chamber situated adjacent said first chamber, a second pipeline allowing fluid communication between the second liquid storage container said second chamber, a first outlet from said first chamber and a second outlet from said second chamber, and a converger for mixing the first fluid and the second fluid exiting from said first outlet and said second outlet, respectively, wherein:

a. said first chamber is provided with a first plunger operable by one motor for pumping fluid from the first liquid storage container to said first chamber via said first pipeline, and b. said second chamber is provided with a second plunger operable by said one motor for pumping fluid from the second liquid storage container to said second chamber via said second pipeline.

Preferably, the first and second liquid storage containers may be sealed containers. The liquid processing assembly may be provided with a third chamber allowing gaseous or air communication between said third chamber and the first and second sealed liquid containers. In this configuration, two pipelines forking off from said third chamber to said first and second sealed liquid containers would be needed. Alternatively, the liquid processing assembly may be provided with a third chamber and a third pipeline allowing gaseous or air communication between said third chamber and the first sealed liquid storage container for pressure equalization in the first sealed liquid container, and a fourth chamber and a fourth pipeline allowing gaseous or air communication between said fourth chamber and the second sealed liquid storage container for pressure equalization in the second sealed liquid container, respectively.

BRIEF DESCRIPTION OF DRAWINGS

Some embodiments of the present invention will now be explained, with reference to the accompanied drawings, in which.

DETAILED DESCRIPTION OF PREFERRED EMBODIMENTS OF THE INVENTION

Figures 1, 2:
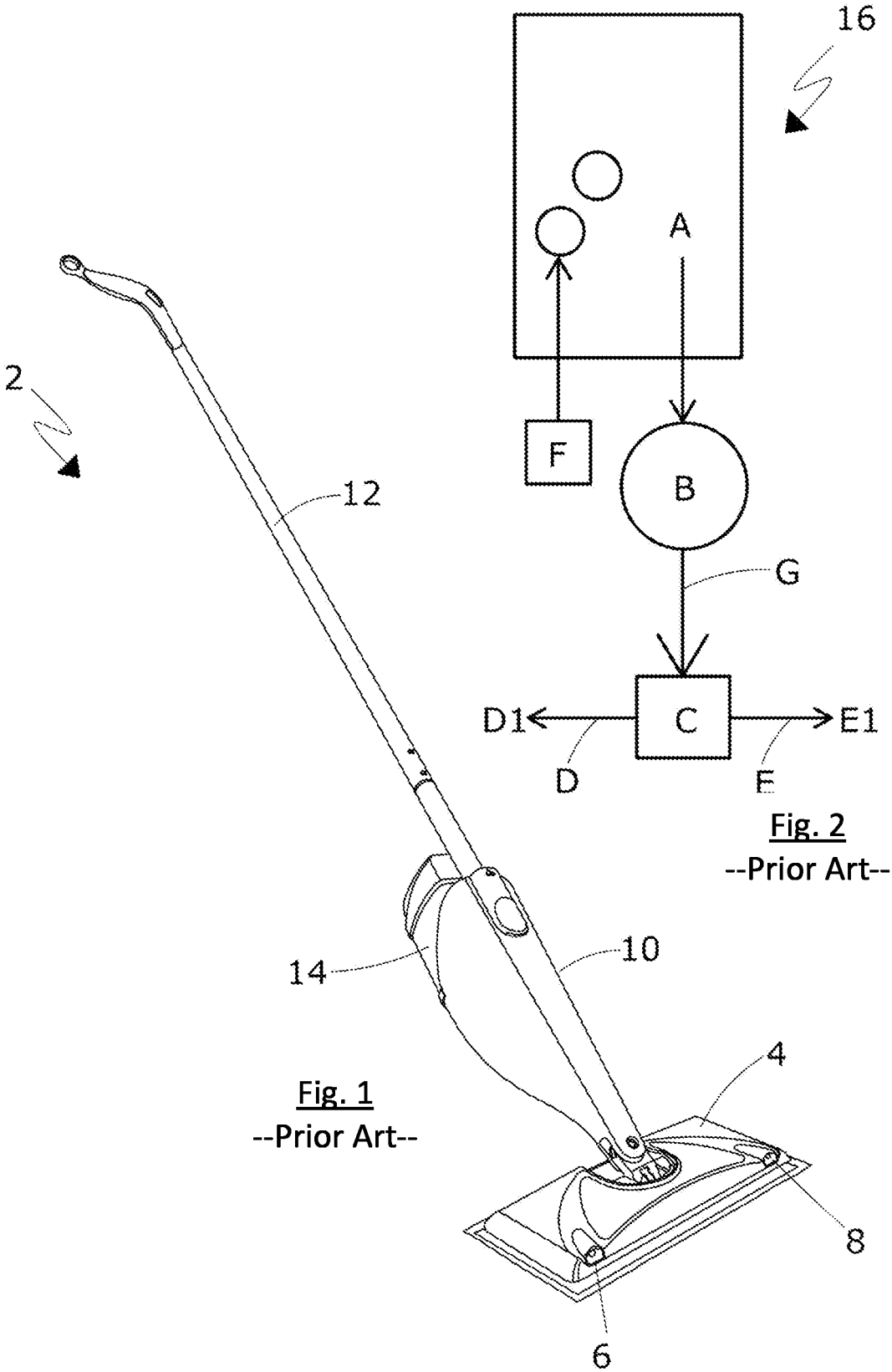
FIG. 1 is a perspective view of a conventional floor cleaning apparatus.
FIG. 2 is a schematic diagram illustrating a liquid delivery assembly comprised in the apparatus of FIG. 1.

FIG. 1 shows a perspective view of a conventional floor cleaning apparatus 2. The apparatus comprises a cleaning head portion 4 provided with two nozzles 6, 8 arranged at opposite lateral sides thereof for forward-discharging of liquid detergent, an upstanding portion 10 and a handle portion 12. The upstanding portion 10 is fitted with a container 14 in the form of a liquid detergent reservoir and means or assembly 16 (represented in FIG. 2) for controlling delivery of liquid detergent from the reservoir to the nozzles 6, 8 for forward-discharging. The delivery means 16 includes a number of cylinders or independent devices provided in separate locations in the apparatus 2 but are otherwise connected together by parts such as conduits, tubings, pipelines, etc.

FIG. 2 is a schematic diagram summarizing the operation of the delivery means 16 of the apparatus 2 of FIG. 1. The delivery means 16 includes a container A (14) for storing liquid detergent, a pump B, a diverger C for forking off or channelling passing liquid detergent to conduits D, E for the respective nozzles D1, E1 for discharge, and a valve means F for allowing air to enter the container A for pressure equalization. The pump B is located at the upstanding portion 10 of the apparatus 2. The diverger C is located in the cleaning head portion 4 of the apparatus 2 and is provided with a check-valve therein for minimizing leakage of liquid detergent from the pump B to the nozzles D1, E1 when the apparatus 2 is not in use and/or when the cleaning head portion is in a tilted orientation. While both the pump B and the valve means F may be located in the upstanding portion 10, it to be noted that the pump B and the diverger C are located in different portions in the apparatus 2 and are connected by the conduits D, E and a conduit G. The pump B is caused to operate, e.g. by the user during use, while the valve means is separately and passively operated when there is a drop in pressure in the container A. A number of problems tend to arise with the apparatus 2 or the delivery means 16. First, with the pump B, the diverger C and the valve means F located and/or operated separately, the construction and assembly of the delivery means 16 and the apparatus 2 is technically complicated in terms of manufacturing of the apparatus 2. Second, since the valve means F is passively operated and is connected to the container 14 filled with liquid detergent which is typically sticky, an air inlet or one-way valve of the valve means F leading to the container 14 tends to experience the problem of "sticking", meaning the air inlet or the one-way valve tends to be clogged up or malfunction over time when the liquid detergent thereat is dried up. Third, the delivery of liquid detergent to the two nozzles 6, 8 are not independent and this also reduces reliability. These are just some of the problems.

Figure 3:
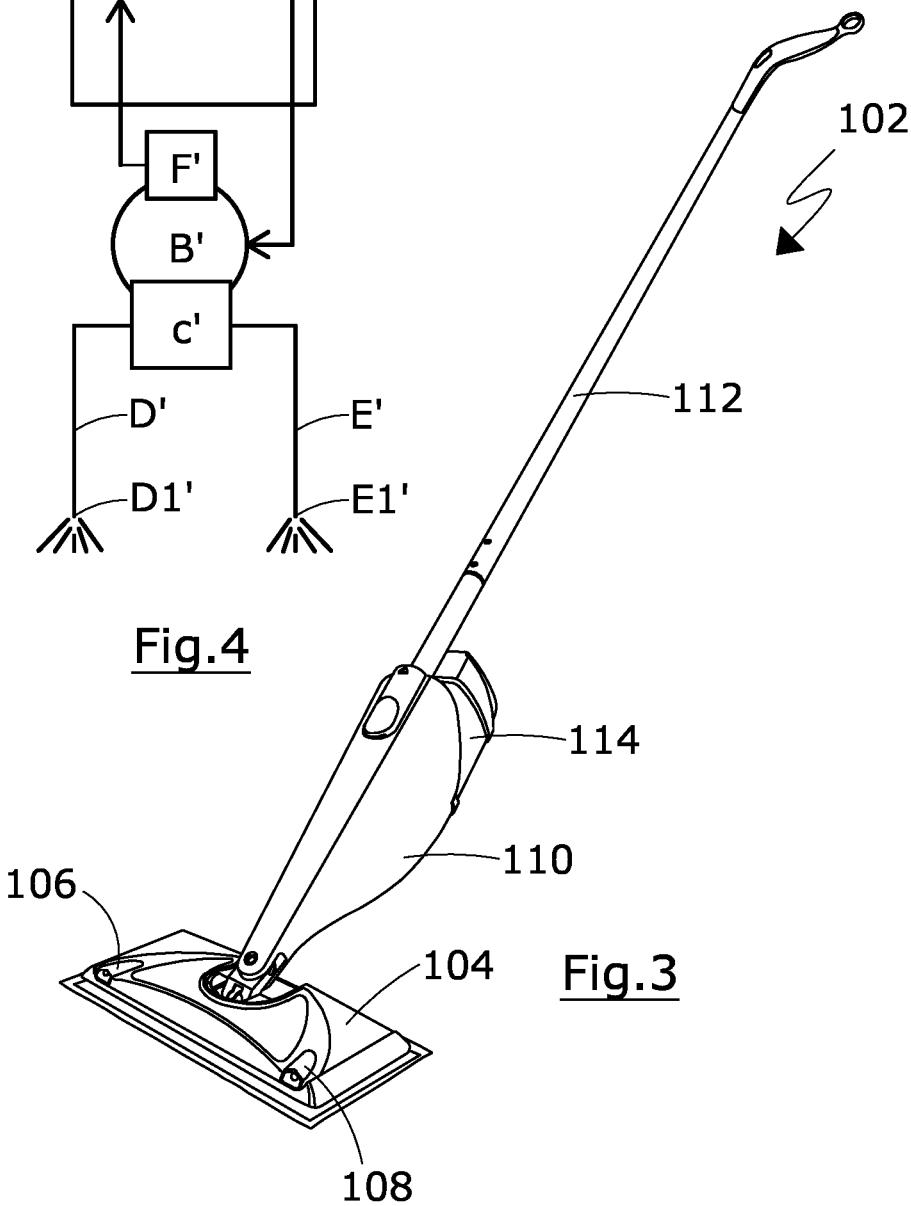
FIG. 3 is a perspective view of an embodiment of a floor cleaning apparatus according to an aspect of the present invention.

FIG. 3 shows a perspective view of an embodiment of a floor cleaning apparatus 102 according to an aspect of the present invention. The apparatus 102 comprises a cleaning head portion 104 provided with two nozzles 106, 108 arranged at opposite lateral sides thereof for forward-discharging of liquid detergent, an upstanding portion 110 and a handle portion 112. The upstanding portion 110 is fitted with a container 114 in the form of a sealed reservoir for liquid detergent storage and an assembly 116 for controlling delivery of the liquid detergent from the reservoir to the nozzles 106, 108 for forward-discharging.

Figure 4:
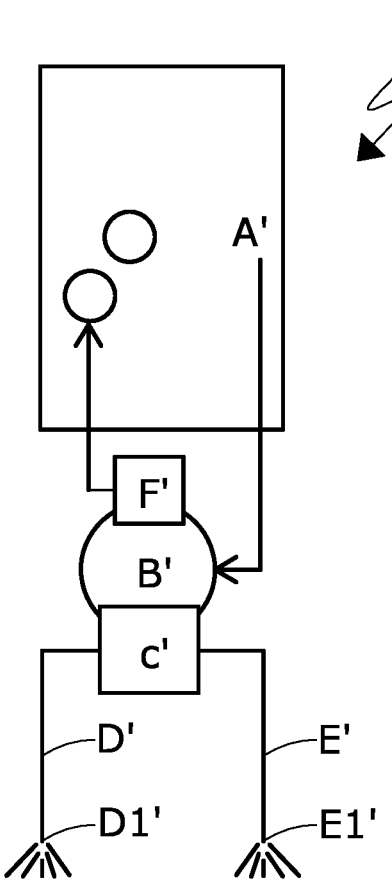
FIG. 4 is a schematic diagram illustrating an embodiment of a liquid delivery assembly comprised in the apparatus of FIG. 3 and according to another aspect of the present invention.

FIG. 4 is schematic diagram of an embodiment of the liquid delivery assembly 116 according to another aspect of the present invention. The delivery assembly 116 includes a container A' (or the sealed liquid container 146) for liquid detergent, a pump unit B', conduits D', E' for the respective nozzles D1' (106), E1' (108), means for diverging flow of fluid to the conduits D' E', and a valve means F' for allowing air to enter the container A' (146) for pressure equalization. Further details of the apparatus 102 and the assembly 116 are explained below.

Figure 5A:
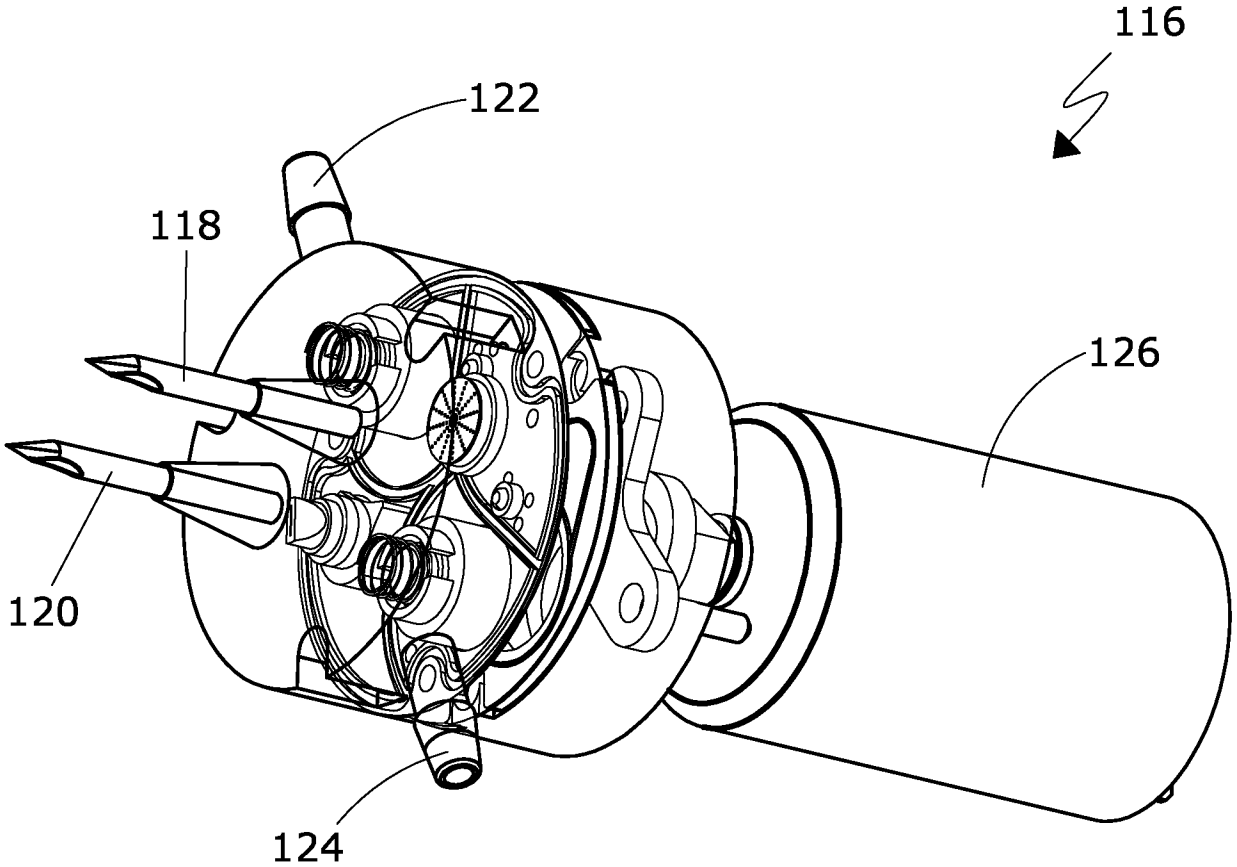
FIG. 5A is a three-dimensional view of the liquid delivery assembly of FIG. 4.

FIG. 5A is a schematic diagram which illustrates the construction of the liquid delivery assembly 116 or at least most of the construction of the assembly 116. The assembly 116 is in the form of an integral operating system having a first pipeline 118 allowing fluid communication from the container 114 to the assembly 116, a second pipeline 120 allowing surrounding air or gaseous communication to travel via the assembly 116 to the container 114 for pressure equalization in the container 114, fluid outlets 122, 124, a battery (not shown) and a motor 126 powered by the battery for operating both fluid flow and air or gaseous flow in the assembly 116. In this embodiment, the sealed liquid container A' (146) has a cap made of a self-sealable silicone membrane material. Both the first and second pipelines are in the form of rigid metallic pipes (e.g. steel pipes) with a sharp end. With this configuration, the pipelines 118, 120 can be inserted into the container A' (140) via the cap and a liquid tight seal is then automatically formed around the pipelines 118, 120.

Figure 5B:
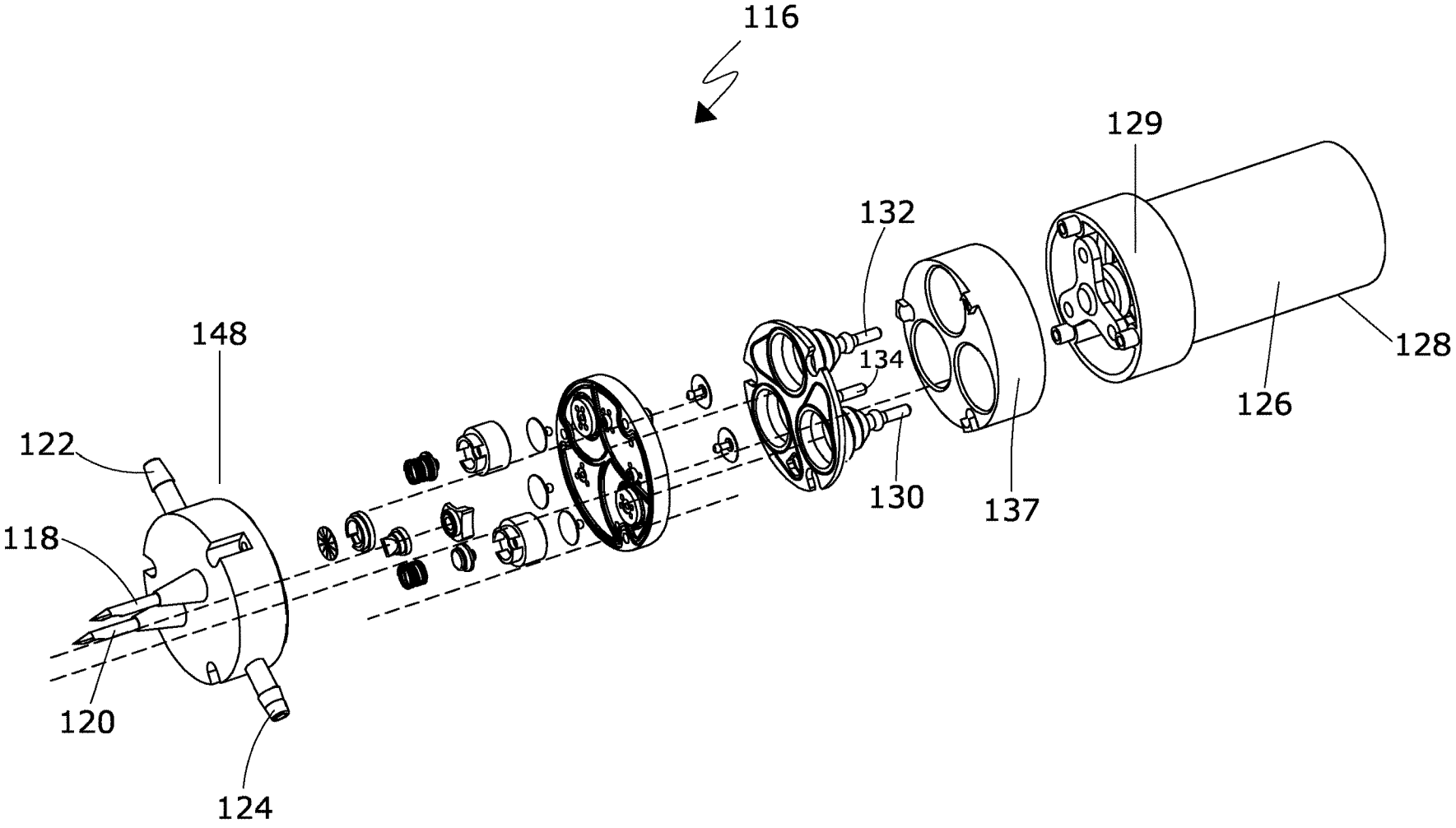
FIG. 5B is an exploded view of the liquid delivery assembly of FIG. 5A.

FIG. 5B is an exploded view of the assembly of FIG. 5A. As shown, the assembly 116 includes a housing 128 for accommodating the motor 126 and a three-cylinder arrangement. The three cylinders in the arrangement are operable by three plungers, 130, 132, 134, respectively. The plungers 130, 132, 134 resemble three pumps drivenable by the motor 126. The housing 128 is provided with a circumferential upper flange 129. The assembly 116 is provided with a lower cap 137 in which the plungers 130, 132, 134 sit and to which the housing 128 engages.

Figure 6:
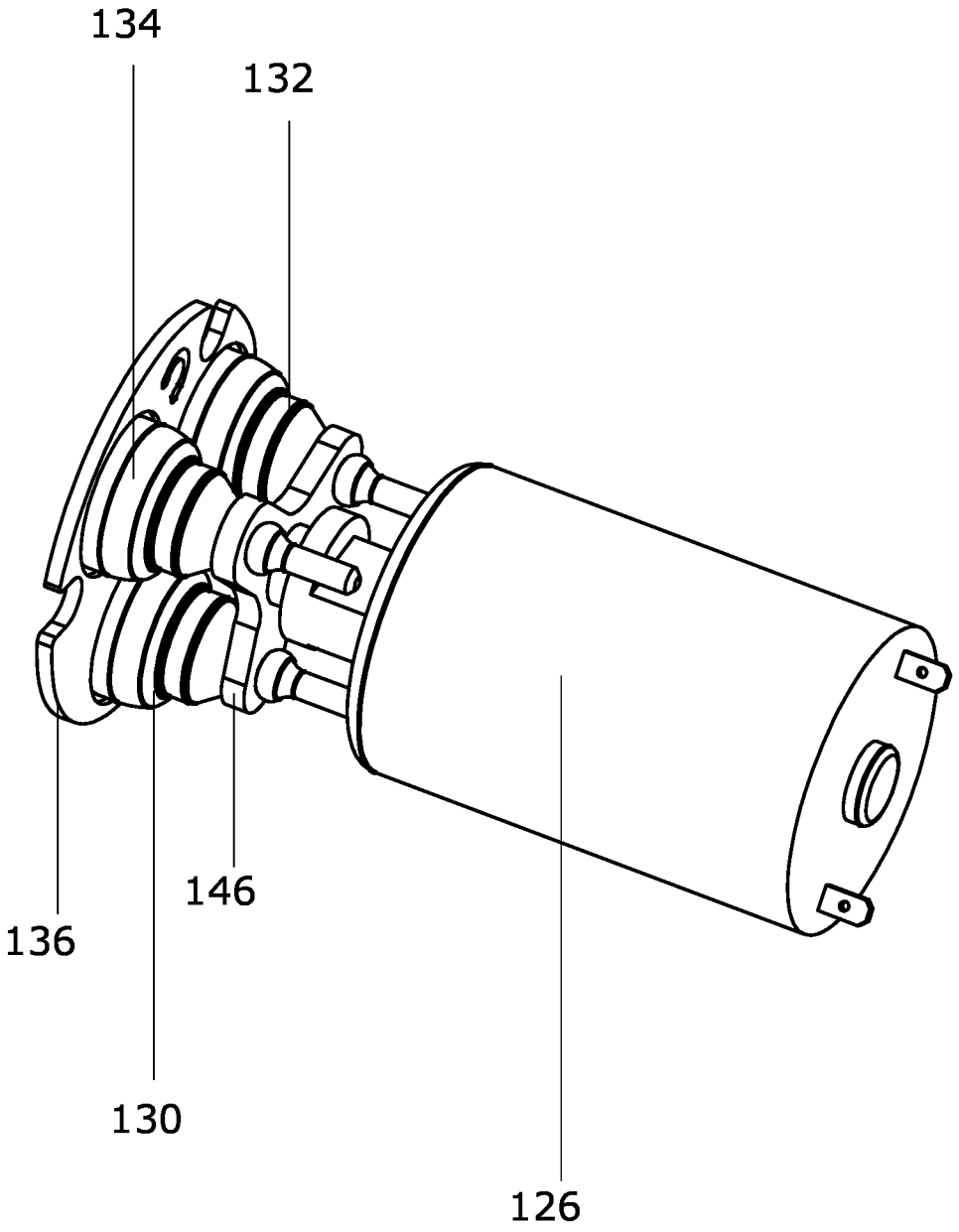
FIG. 6 is a perspective view of the liquid delivery assembly of FIG. 5A but with top and middle caps thereof removed.

FIG. 6 is a perspective view of a lower portion the assembly 116 of FIG. 5A but with the housing 128 removed. In this figure, the three plungers 130, 132, 134, are more clearly shown. There is provided a wall 136 defining a lower surface to which the top of the three plungers 130, 132, 134 engage and connect. The plungers 130, 132, 134 are operable by a wobbleable plate 146 which is movable by an axle of the motor 126.

Figure 7A:
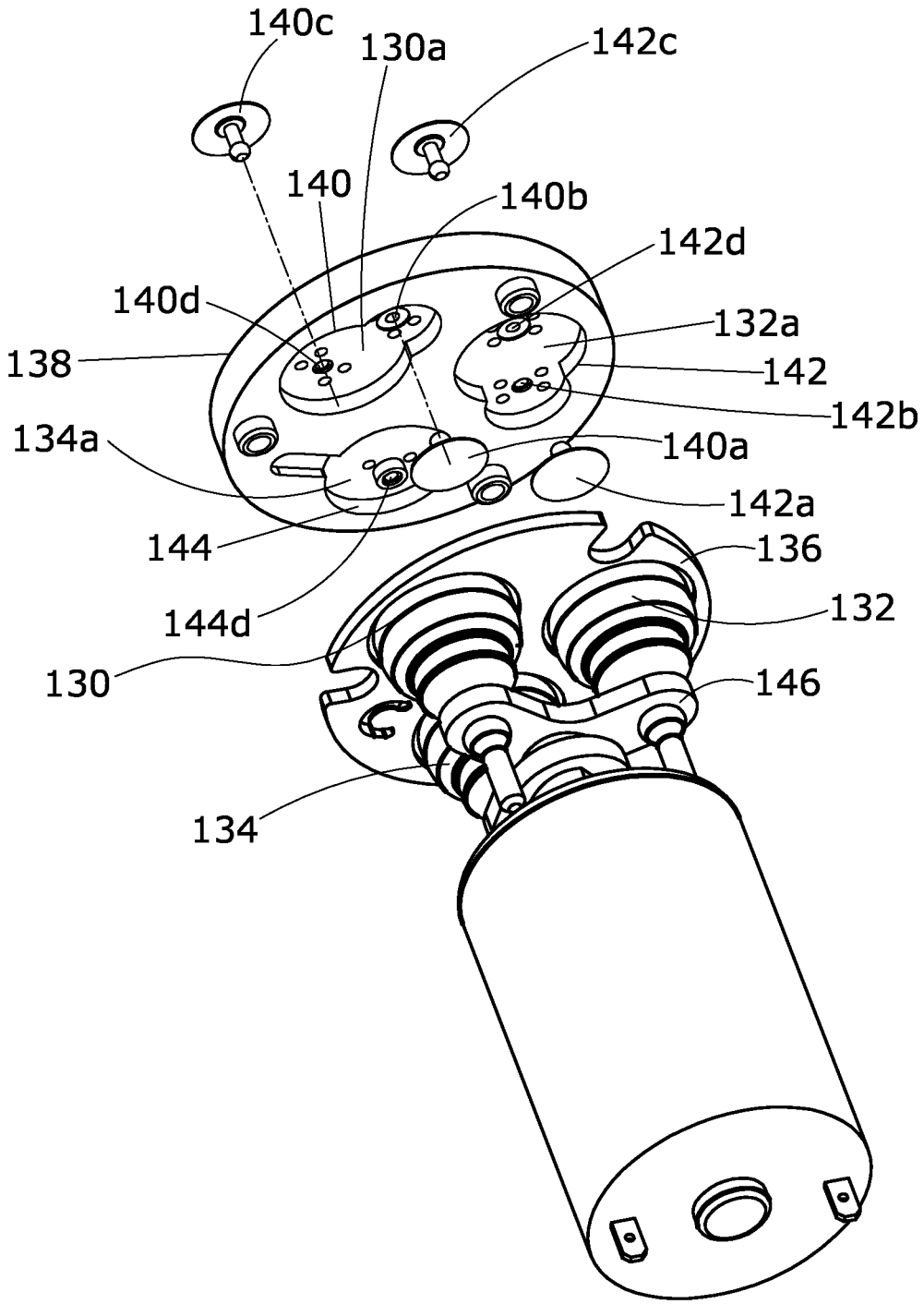
FIG. 7A is an exploded view of the liquid delivery assembly of FIG. 5A but with the top cap thereof removed.
Figure 7B:
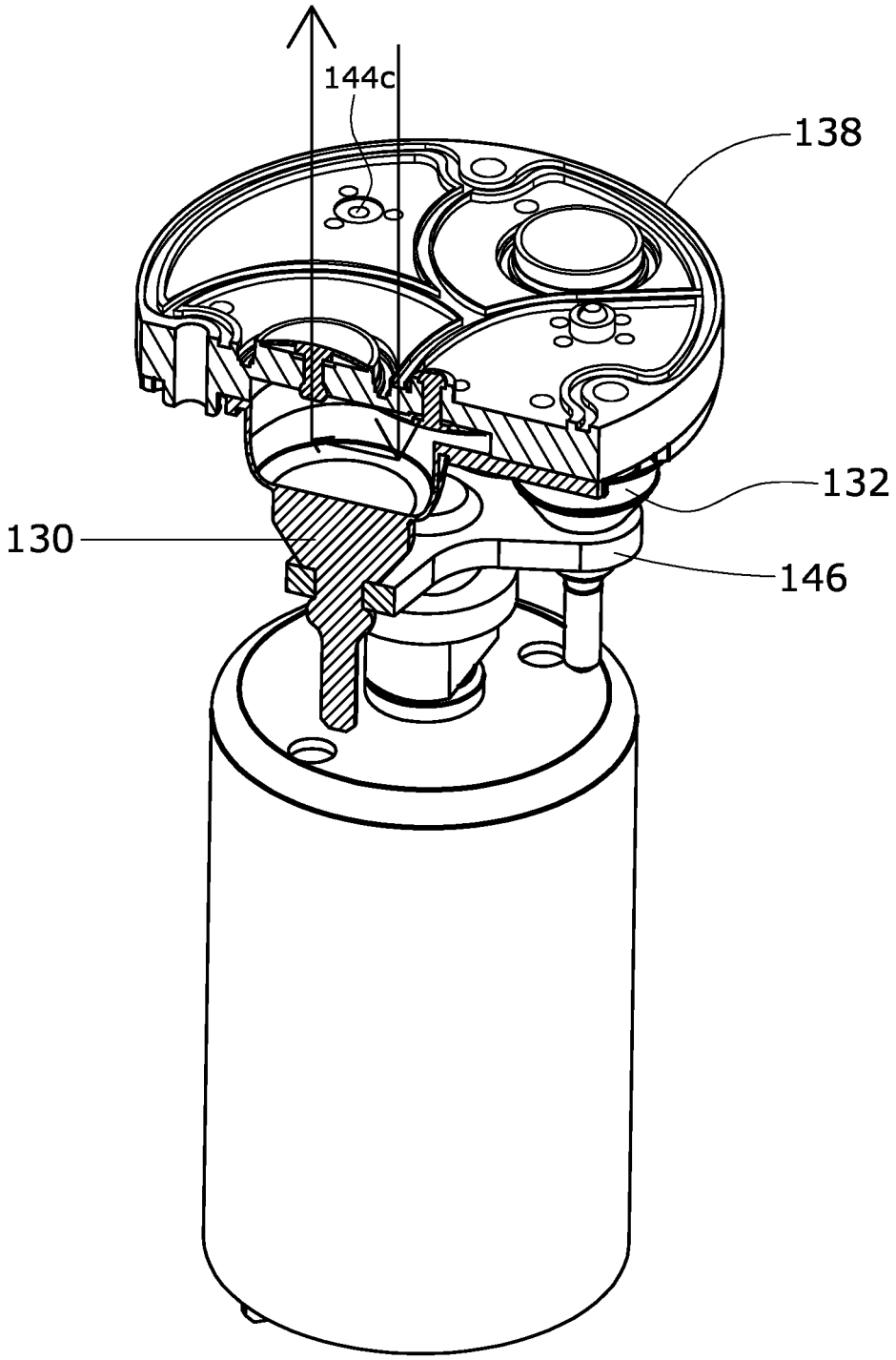
FIG. 7B is a schematic view of the liquid delivery assembly of FIG. 7A.

FIG. 7A is a perspective and exploded view of the lower portion of the assembly 116 of FIG. 6 but with a middle cap 138. The bottom view of the middle cap 138 is shown. FIG. 7B generally corresponds to FIG. 7A, but also shows the top view of the middle cap 138. (It is to be noted that reference to "top", "bottom", etc. in this specification refers to the relative position thereof, and is not intended to be limiting in terms of absolute orientation.) The bottom surface of the middle cap 138 is provided with three recesses 130*a*, 132*a*, 134*a*, respectively. It can thus be understood that cavities are provided or defined at the recesses 130*a*, 132*a*, 134*a* between the middle cap 138 and the wall 136. In this embodiment, three chambers are generally defined between the middle cap 138 and the three plungers 130, 132, 134. The three cylinders mentioned above correspond to these three regions. The three cylinders include two cylinders for fluid transfer and one cylinder for air or gaseous transfer. The three regions are region 140, region 142 and region 144.

The middle cap 138 at the region 140 is provided with a one-way valve 140*a* for allowing single direction fluid flow via an opening 140*b* from above to below across the middle cap 138. The middle cap 138 at region 140 is also provided with a one-way valve 140*c* for allowing single direction fluid flow via the opening 140*d* from below to above across the middle cap 138. FIG. 7B illustrates the working of the plunger 130. Please see the plunger 130 in hashed lines. The arrows illustrate that, when the plunger 130 is operated by the motor 126 via a wobbleable plate 146, fluid is caused to travel via the opening 140*b* from above to below across the middle cap 138, and then via the opening 140*d* from below to above the middle cap 138.

Region 142 of the middle cap 138 is similar to the region 140 in that the region 142 likewise is provided with the one-way valve 142*a* for allowing single direction fluid flow via the opening 142*b* from above to below across the middle cap 138. The middle cap 128 at the region 142 is provided with one-way valve 142*c* for allowing single direction fluid flow via the opening 142*d* from below to above across the middle cap 138. Flow of fluid in the region 142 is caused by the plunger 132 operated by the same motor 126.

Region 144 of the middle cap 138 is somewhat dissimilar to the regions 140, 142. Structurally, there is provided a one-way valve 144*c* (see FIG. 7B). Functionally, the one-way valve 144*c* is configured to allow single direction gas or air flow via an opening 144*d* from below to above across the middle cap 138. Although not shown in FIGS. 7A and 7B, the region 144 is provided with an air inlet 164 at the wall 136 for allowing air or gas to enter the chamber defined by or between the middle cap 138 and the plunger 134.

It can thus be understood that, due to the presence of two chambers corresponding to the regions 140, 142, two fluid flow paths are defined by the assembly 116. It can also be understood that, due to the presence of one chamber corresponding to region 144, one air or gaseous flow path is defined by the assembly 116. The two fluid chambers and the one air/gas chamber and the respective plungers 130, 132, 134 can thus be understood as the three-cylinder arrangement.

Figure 8A:
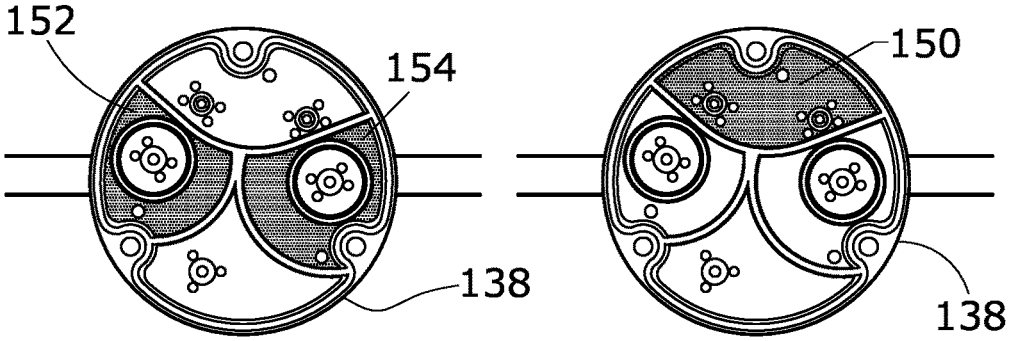
FIG. 8A is a schematic diagram illustrating different chambers (or zones) defined in the liquid delivery assembly of FIG. 5A.

FIG. 8A are two schematic diagrams, namely left and right, illustrating two states of the region 140 of the middle cap 138 shown in FIG. 7A, when the assembly 116 is in operation. Specifically, FIG. 8A right shows the top view of the middle cap 138 while FIG. 8A left the bottom view of the middle cap 138 in operation.

Figure 8B:
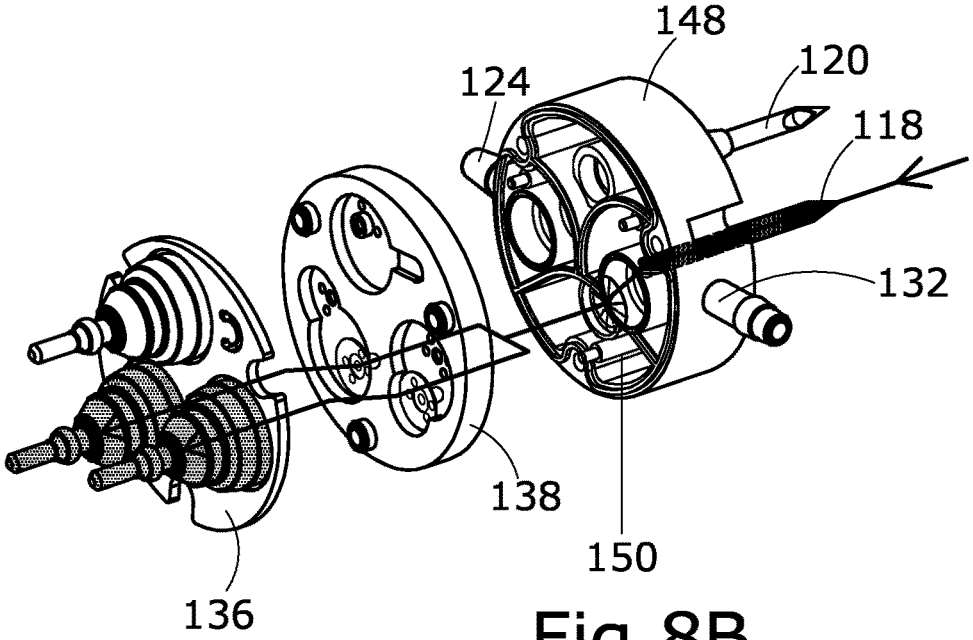
FIGS. 8B and 8C are schematic diagrams of the liquid delivery assembly of FIG. 5A but with a lower portion thereof removed.
Figure 8C:
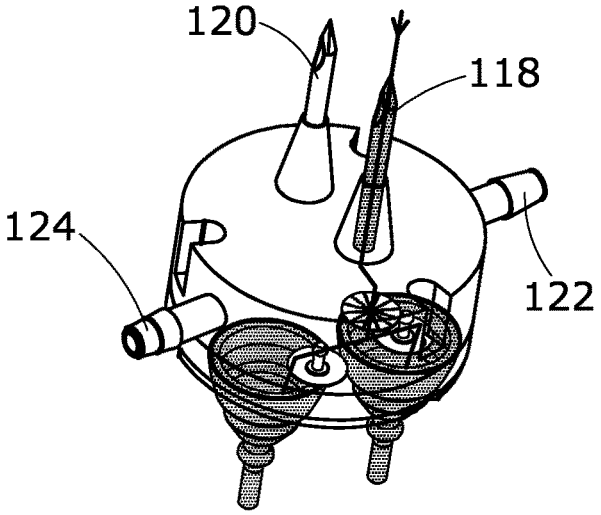

FIG. 8B and FIG. 8C are two schematic diagrams corresponding to FIG. 8A right. It is to be noted that FIG. 8B and FIG. 8C show not only the assembly 116 of FIG. 7A and FIG. 7B but also the assembly 116 with a top cap 148. As such, FIGS. 8B and 8C further illustrate chambers defined between the top cap 148 and the middle cap 138, and fluid communication from the container 114 via the first pipeline 118 then to successive chambers. From FIG. 8B, it can be understood that the middle cap 138 and the top cap 148 together defines a chamber 150 therebetween. As fluid is drawn from the container 114 via the first pipeline 118 to the assembly the 116, the fluid firstly arrives the chamber 150. The grey area in FIG. 8A right illustrates the upper surface of the middle cap 138 and the zone between the top cap 148 and the middle cap 138 when the chamber 150 is filled with the fluid. The assembly 116 is also provided with a chamber 152 and a chamber 154 between the middle cap 138 and the wall 136. The chamber 152, 154 are the zones between the middle cap 138 and the wall 136. The assembly 116 is constructed such that the fluid in the chamber 150 can then travel and fork off via the opening 140*b* and 142*b* to the chamber 152 and the chamber 154, respectively. The arrows in FIGS. 8B and 8C illustrate the fluid flow pattern when the assembly 116 is in operation. The grey area in FIG. 8A left illustrates the chambers 152, 154 filled with the fluid travelled from the chamber 150.

Figure 9A:
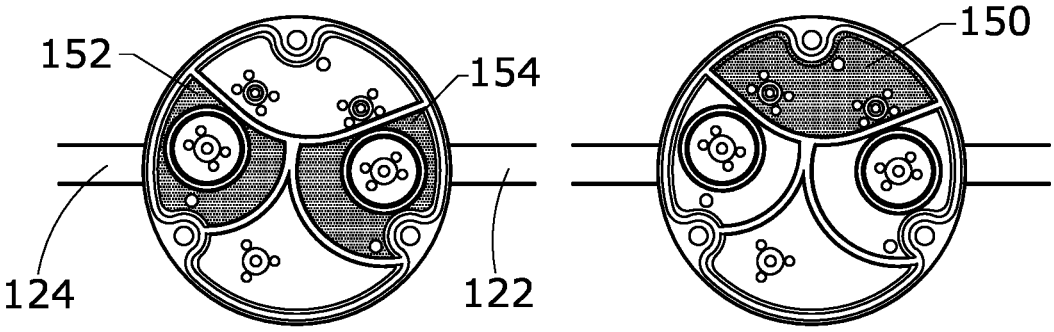
FIG. 9A is a schematic diagram illustrating different chambers (or zones) defined in the liquid delivery assembly of FIG. 5A.

FIG. 9A are two schematic diagrams, namely left and right, illustrating two states of the middle cap 138 shown in FIG. 7A when the assembly 116 is in operation.

Figure 9B:
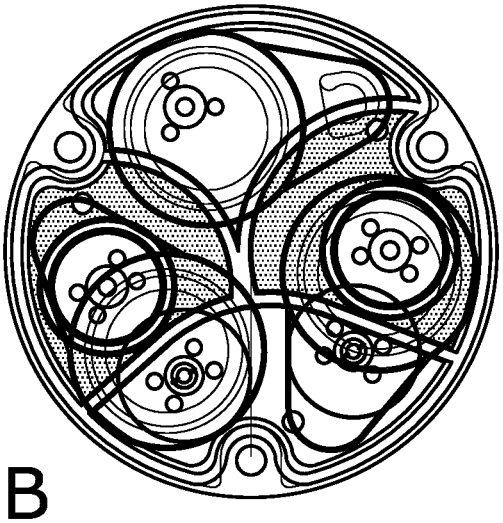
FIGS. 9B and 9C are schematic diagrams of the liquid delivery assembly of FIG. 5A also with the lower portion thereof removed.
Figure 9C:
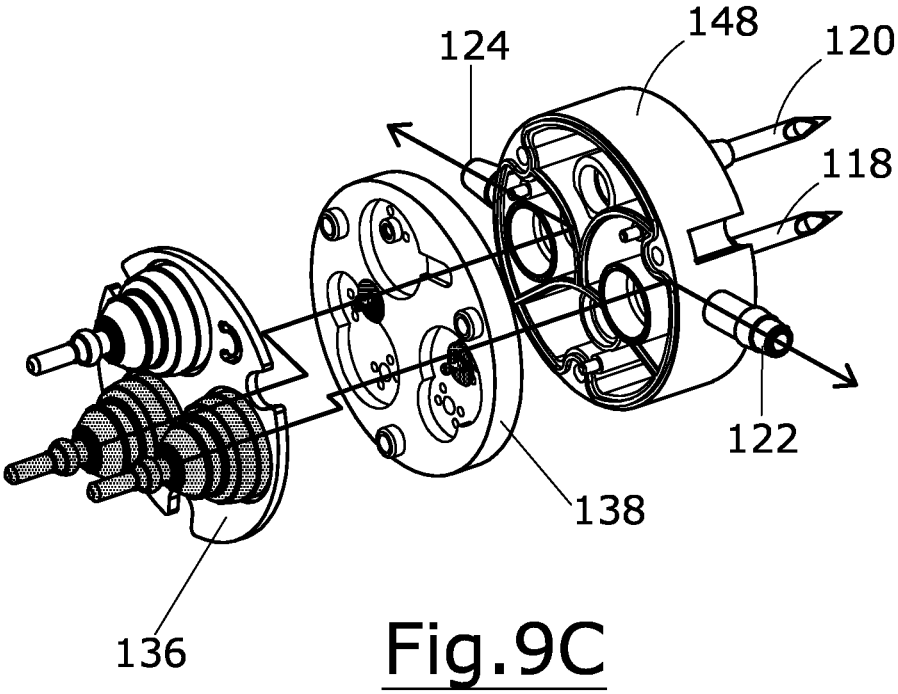

FIG. 9B and FIG. 9C are two schematic diagrams corresponding to FIG. 9A left, illustrating fluid communication from the chambers 152, 154 to the nozzles 122, 124, respectively. From FIGS. 8A-8C, after the fluid has reached chambers 152, 154, continuous working of the plungers 130, 132 will drive the fluid away chamber 152, 154 via the openings 140*d*, 142*d* and then the valves 140*c*, 142*c*, respectively. The fluid will then exit the nozzles 122, 124, respectively. The nozzles 122, 124 are arranged on or extended from opposite lateral sides of the upper cap 148. The arrows in FIG. 9C illustrate the subsequent fluid flow pattern when the assembly 116 is in use.

Figure 10A:
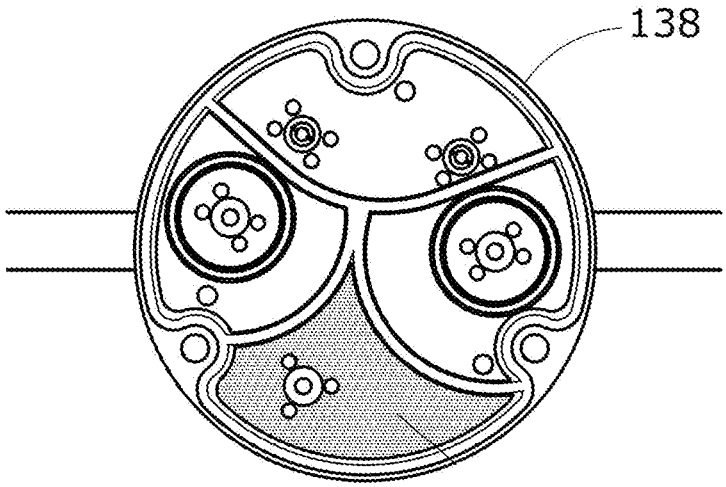
FIG. 10A is a schematic diagram illustrating different chambers (or zones) defined in the liquid delivery assembly of FIG. 5A.
Figure 10B:
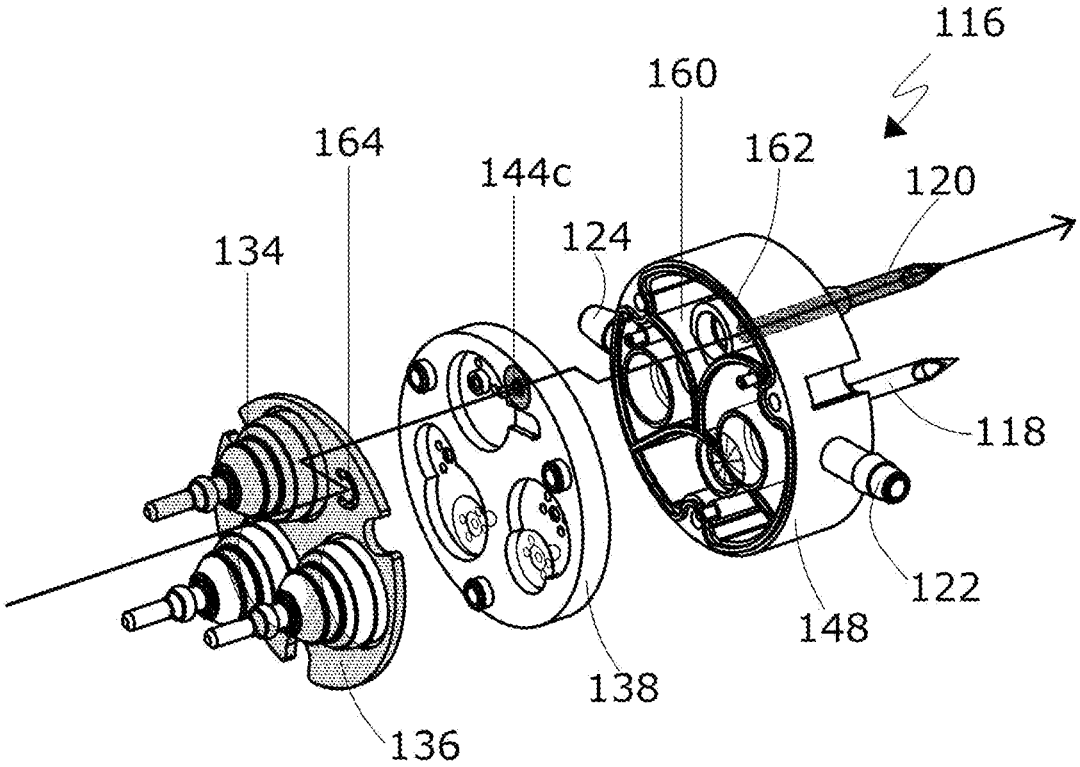
FIG. 10B is a schematic diagram of the liquid delivery assembly of FIG. 5A also with the lower portion thereof removed.

FIG. 10A is a schematic diagram illustrating a state of the middle cap 138 shown in FIG. 7A. FIG. 10B is a schematic diagram corresponding to FIG. 10A illustrating air or gaseous communication path from the surrounding to the second pipeline 120. A chamber 160 is provided at the region 144 between the top cap 148 and the middle cap 138, as represented by the zone in the grey in FIG. 10A. FIG. 10B shows an air inlet 164 at the wall 136 for allowing entry of surrounding gas or air, a one-way valve 144*c* for controlling the state of an aperture 144*d* at the middle cap 138 thus to control entry of surrounding gas to the chamber 160, and a one way-valve 162 for controlling the air or gas to travel from the chamber 160 to the container 114 via the pipeline 120. The arrow in FIG. 10B illustrates the air flow path.

Figure 11:
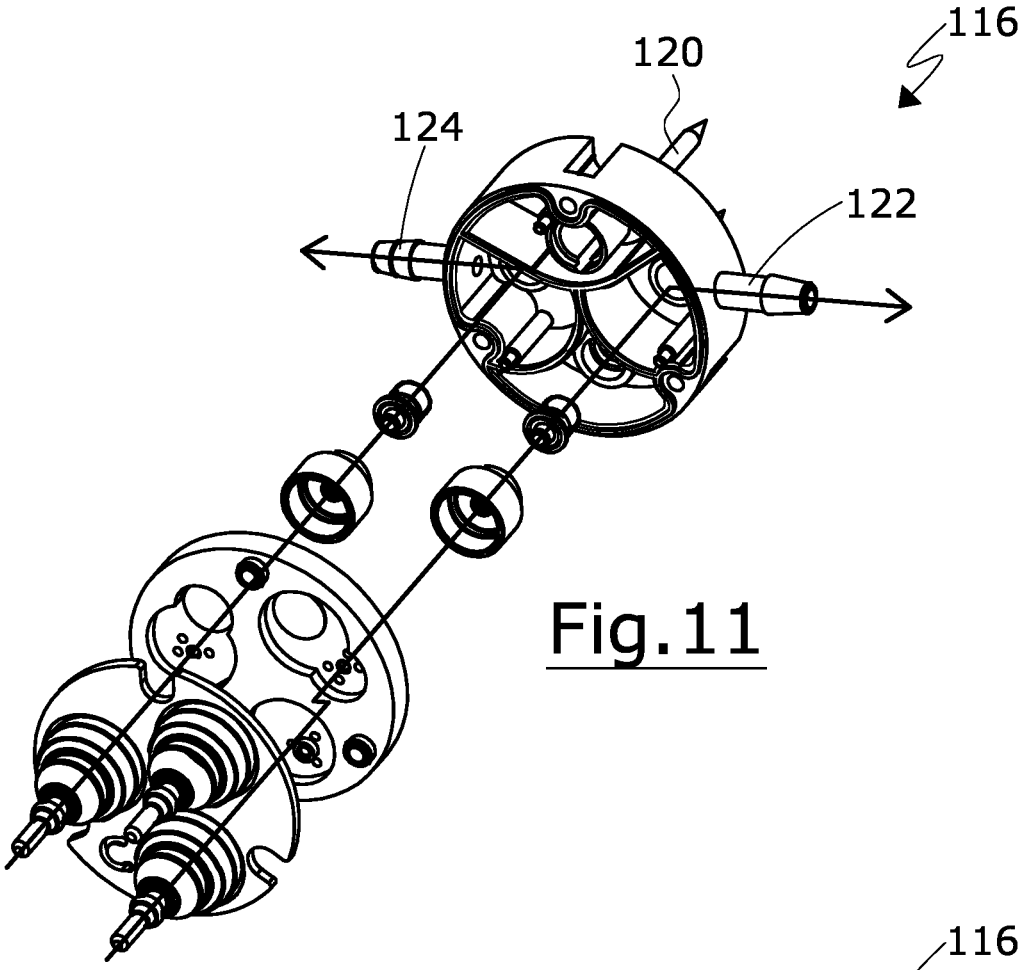
FIG. 11 is a schematic diagram illustrating, in operation, liquid flow path via the liquid delivery assembly of FIG. 5A.
Figure 12:
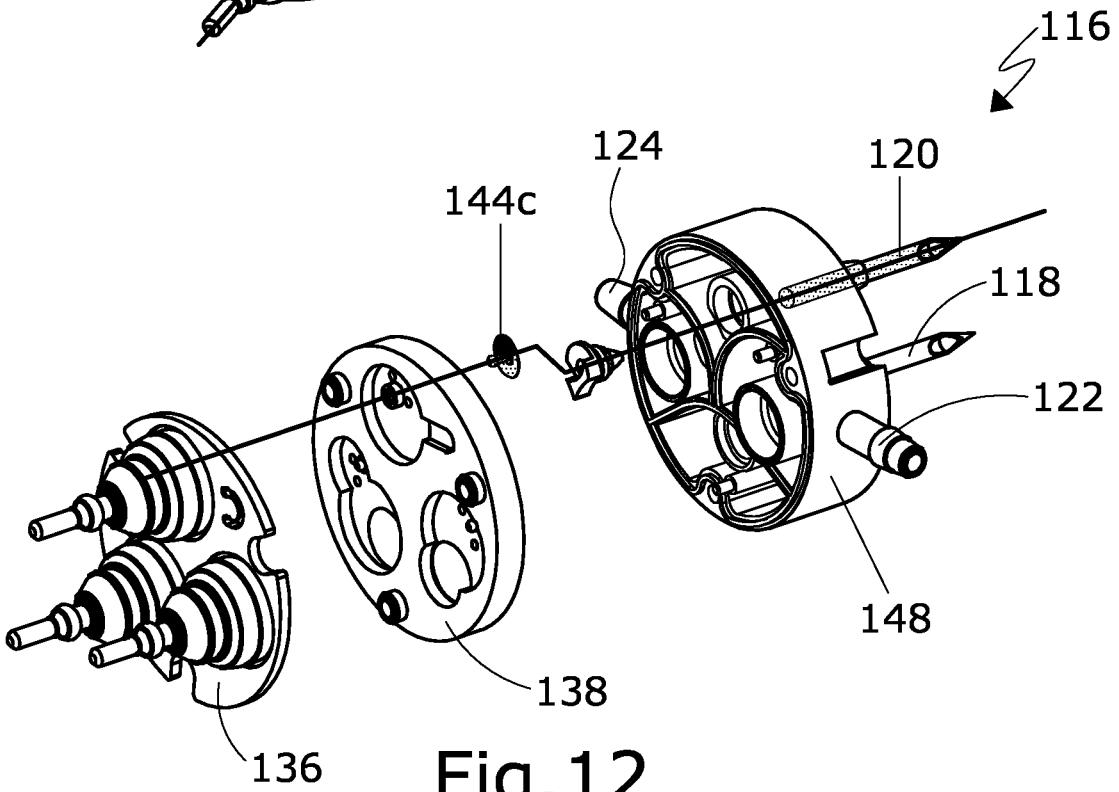
FIG. 12 is a schematic diagram illustrating, in operation, air or gas flow path via the liquid delivery assembly of FIG. 5A.

FIG. 11 and FIG. 12, corresponding to FIG. 9C and FIG. 10B, respectively, are schematic diagrams illustrating simultaneous fluid flow and gas/air flow when the assembly 116 is in operation.

In order to further explain the structure and working of the assembly 116, FIGS. 13A-13B and 14A-14B illustrate the schematics of the assembly. FIGS. 13A-13B and 14A-14B should be reviewed together with at least FIG. 7A for ease of understanding.

Figure 13B:
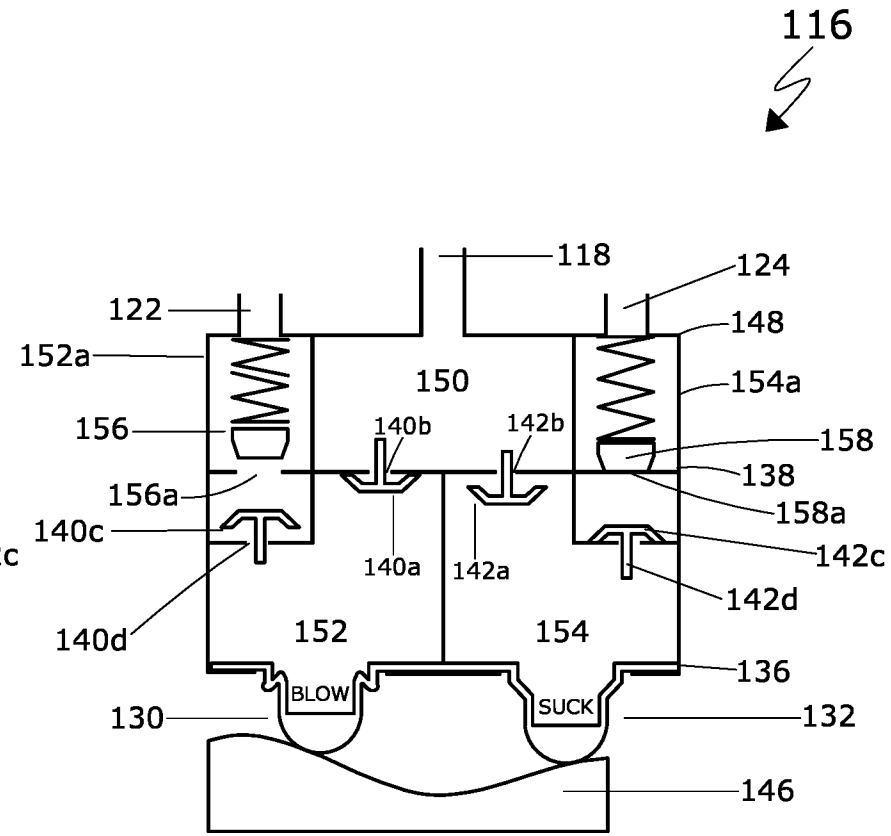
FIGS. 13A and 13B are schematic diagrams showing two different states of the liquid delivery assembly of FIG. 5A.
Figure 13A:
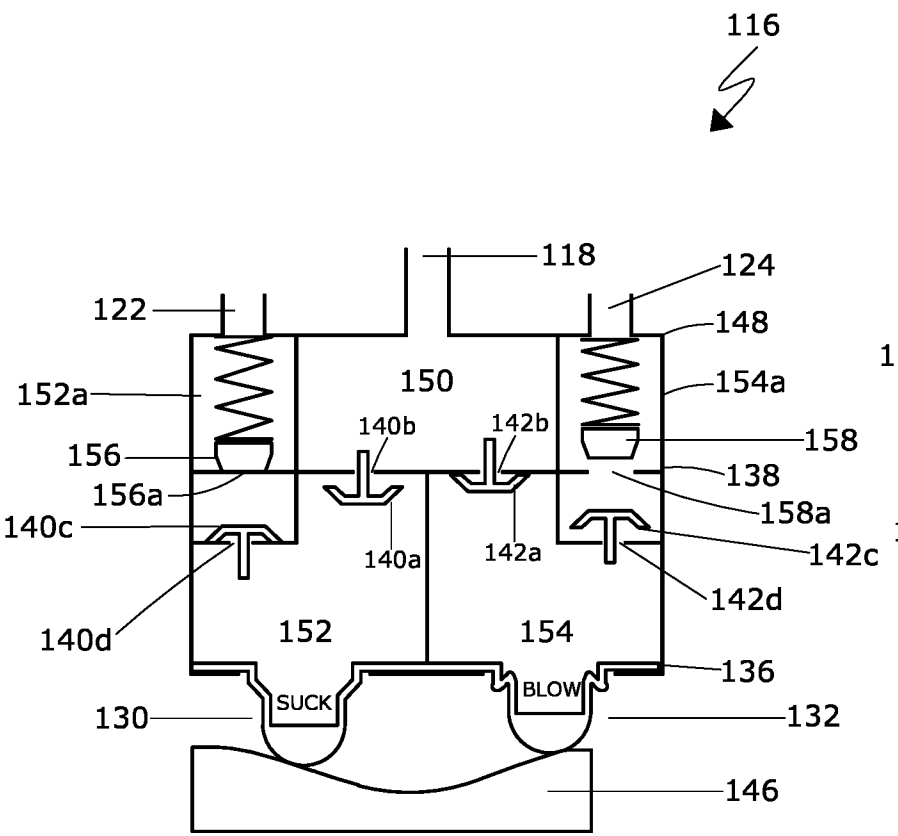

Generally, FIGS. 13A-13B illustrate two configurations of a fluid transfer mechanism in the assembly 16 when fluid transfer in the assembly is taking place.

FIG. 13A illustrates the assembly 116 including the chamber 150 and the pipeline 118 for supplying fluid to the chamber 150 and then separately to the chamber 152 and the chamber 154. The chamber 150 is provided with the one-valve 140*a* for controlling the state of the aperture 140*b* and the one-valve 142*a* for controlling the state of the aperture 142*b*.

The chamber 152 is provided with a sub-chamber 152*a* extended therefrom and the one-valve 140*c* for controlling the state of the aperture 140*d*. The sub-chamber 152*a* is further provided with a spring-loaded valve 156 for controlling an aperture 156*a* before fluid exits for the nozzle 122.

Similar to the chamber 152, the chamber 154 likewise has a sub-chamber 154*a* extended therefrom and the one-valve 142*c* for controlling the state of the aperture 142*d*. The sub-chamber 154*a* is further provided with a spring-loaded valve 158 for controlling an aperture 158*a* before fluid exits for the nozzle 124.

FIG. 13A shows the assembly 116 in a first configuration. In this configuration, when the plunger 130 for the chamber 152 is caused by a first end of the wobbleable plate 146 to assume a low position, a suction effect (i.e. a drop in pressure) is generated, causing the one-way valve 140*b* to open so as to allow fluid to travel from the chamber 150 to the chamber 152 via the aperture 140*b*. At the same time, the suction closes the one-way valve 140*c*.

While the plunger 130 for the chamber 152 is caused by the one end of the wobbleable plate 146 to be in the low portion, the plunger 132 for the chamber 154 is caused by a second end of the wobbleable plate 146 to assume a high position. As a result, a blowing effect (i.e. an increase in pressure) is generated, causing the one-way valve 142*a* to close, and the one-way valve 142*c* and the spring loaded valve 158 to open, so as to allow fluid to travel from the chamber 154 to the sub-chamber 154*a* then to the nozzle 122 via the aperture 142*c* and then the aperture 158*a*.

FIG. 13B shows the assembly 116 in a second configuration. In this configuration, when the plunger 130 is now caused by a third end of the wobbleable plate 146 to assume a high position, a blow effect is generated, causing the one-way valve 140*a* to close and the one-way valve 140*c* and the spring-loaded valve 156 to open, so as to allow fluid to travel from the chamber 152 to the sub-chamber 152*a* then to the nozzle 122 via the aperture 140*d* and the aperture 156*a*. It can be envisaged that the wobbleable plate 146 has a three-prong profile, with the three prongs engaged with the plungers 130, 132, 134, respectively.

When the plunger 130 is caused by the first end of the wobbleable plate 146 to assume a high position, the plunger 132 is now caused by the second end of the wobbleable plate to assume a low portion. As a result, a suction is generated causing the one-way valve 142*d* to open so as to allow fluid to travel from the chamber 155 to the sub-chamber 154 via the aperture 142*b*. At the same time, the suction closes the one-way valve 142*c*.

As the wobbleable plate 146 connected to the plungers 130, 132 reciprocatingly and alternatingly pushes and pull, the plungers 130, 132 assume alternating positions thus pumping fluid through the pipeline 118, then to chamber 150, then forking off to the chambers 152, 154, then to the sub-chambers 142*a* and 154*a*, and eventually reaching the nozzles 122, 124, respectively.

Figure 14C:
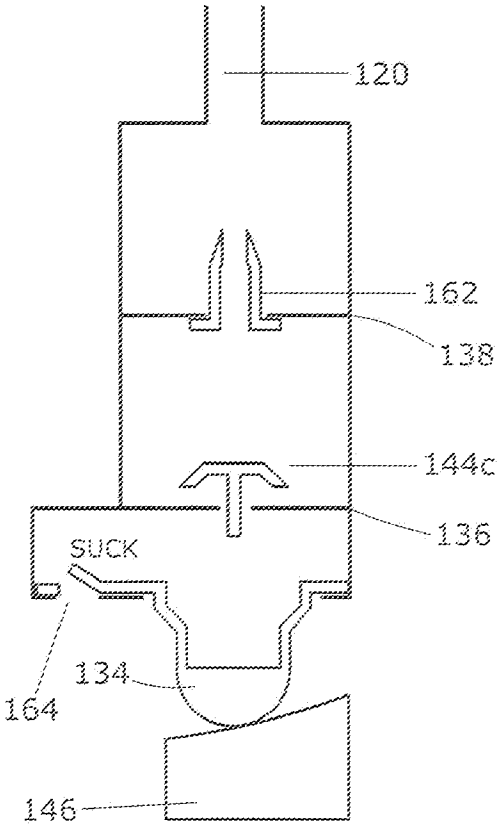
FIGS. 14A, 14B and 14C are schematic diagrams showing three different states of the liquid delivery assembly of FIG. 5A.
Figure 14B:
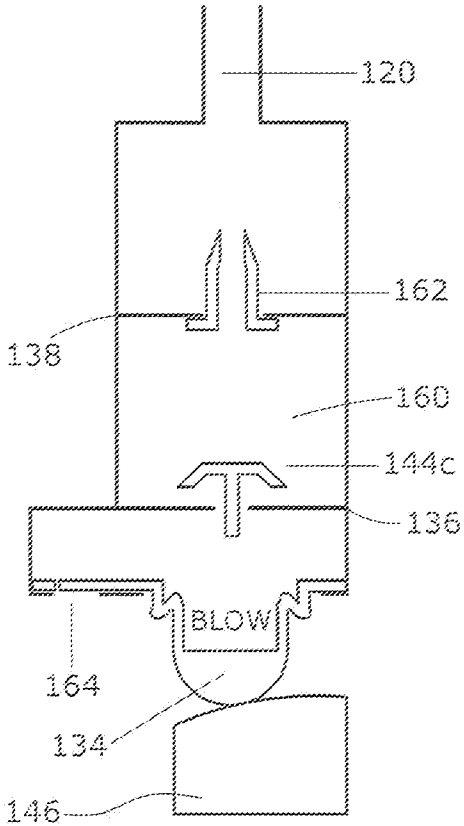
Figure 14A:
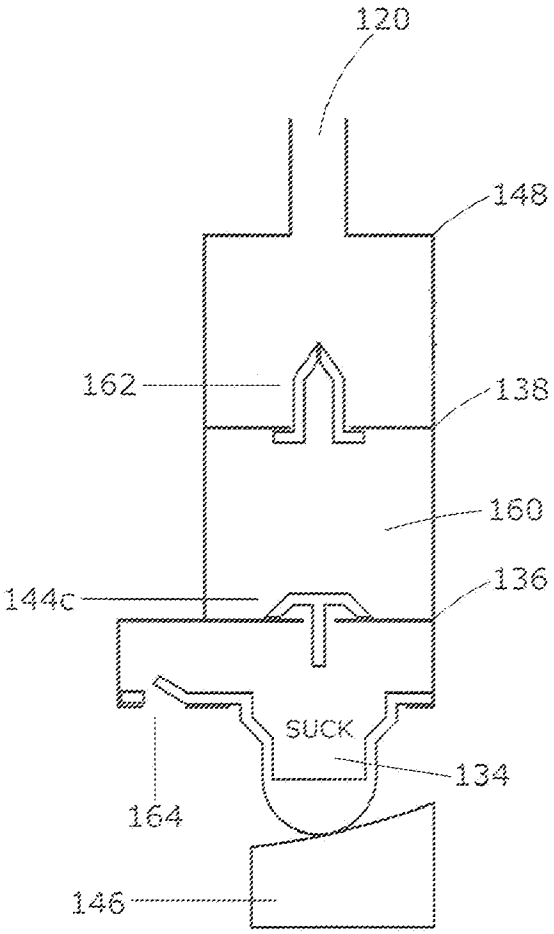

FIGS. 14A-14C show three configurations of an air or gas delivery mechanism in the assembly 116 for equalizing pressure in the container 114 when the assembly 116 is in operation. Specifically, FIGS. 14A-14C show that the assembly 116 includes the chamber 160 defined between the top cap 148 and the middle cap 138, the plunger 134 for operating the chamber 160, the inlet 164 leading to the chamber 160, the one-way valve 144*c* for controlling surrounding air or gas to enter the chamber 160, the one-way valve 162 for controlling the air to travel from the chamber 160 to the container 114 via the pipeline 120.

FIG. 14A illustrates a first configuration of the pressure equalizing mechanism in which the plunger 134 is in its low position. This low or initial position of the plunger 134 generates a suction and causes the both the one-way valves 144*c*, 162 to close while the inlet 164 is open.

FIG. 14B illustrates that as the plunger 134 is upwardly moved by the first end (or prong) of the wobbleable plate 146, an initial pumping effect is generated and as a result the inlet 164 is closed while both the one-way valves 144*c*, 162 are open.

FIG. 14C illustrates that once both the one-way valves 144*c*, 162 are open, lower or negative pressure in the chamber 160 causes the inlet 164 to also open, allowing air to travel from the surrounding into the container 114 such that pressure lost in the sealed liquid container is replenished. As the plunger 134 is reciprocatingly operated by the wobbleable plate 146, pressure in the container 114 is continuously replenished and maintained. It is to be understood that the displacement volume of the gas cylinder made from the chamber 160 does not need to match the displacement volume of the liquid cylinders made from the chambers 150, 152, 154 because due to the negative pressure a respective amount of air will be automatically drawn into the sealed liquid detergent container 114 until the pressure is equalized.

It is to be noted that all three plungers 130, 132, 134 are alternatively operated by these distal ends (or prongs) of the wobbleable plate 146. Thus, when the assembly 116 is discharging liquid from the sealed liquid container 116 via the conduits 122, 124, pressure drop in the sealed liquid is being replenished and fluid flow from the container 114 to the chamber 150 would not be hindered.

Figure 15B:
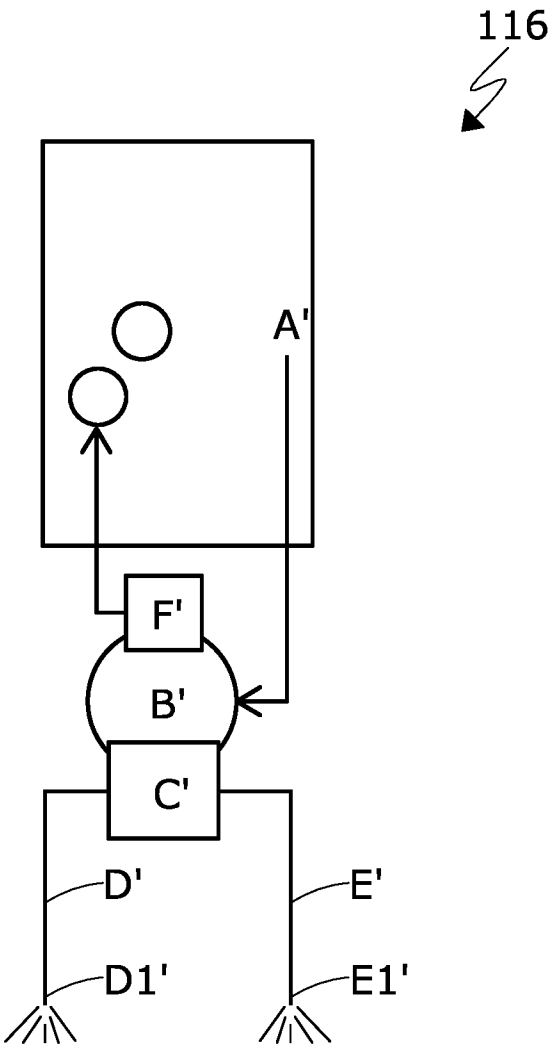
FIGS. 15A and 15B are side-by-side representations of the conventional liquid delivery assembly of FIG. 2 and the novel liquid delivery assembly, respectively.
Figure 15A:
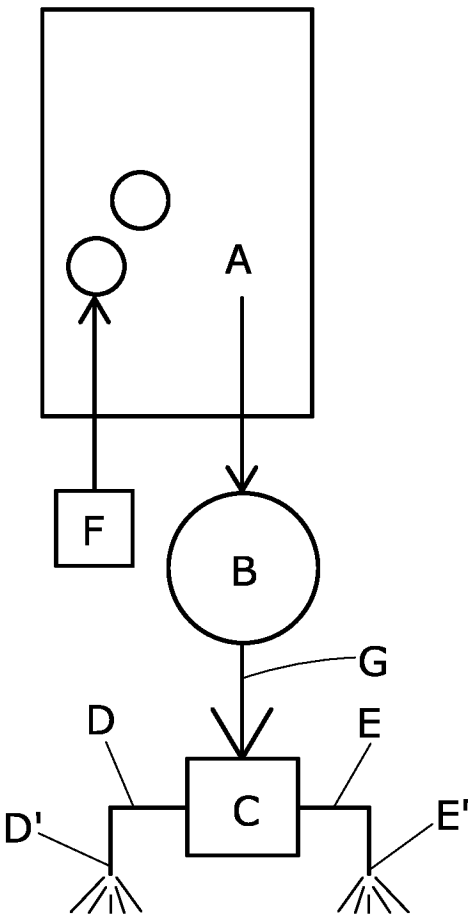

FIG. 15A and FIG. 15B correspond to FIG. 2 and FIG. 4, respectively, but are presented side for side for ease of comparison. FIG. 15A represents the liquid delivery means 16. In this means 16, three discrete units, i.e. the pump B, the diverger C, and the valve means F, are separately provided. With this configuration, while the pump B is actively operated, the diverger C and the valve means F are passively operated.

FIG. 15B represents the liquid delivery assembly 116. In this assembly 116, the pump B', the means for diverging fluid to the conduits D', E' and the valve means F' are integrally formed. In other words, they are parts of a discrete unit. For example, the assembly 116 provides a number of cylinders and chambers separated by partitions and operation of the cylinders and fluid flow and air flow in the integral assembly 116 is effected by one motor. Further, the floor cleaning portion 104 does not have any diverger for channelling fluid to the two nozzles 106, 108. The diverging function is already provided by the integral assembly 116 installed in the upstanding portion 110 of the apparatus 102. Leakage of fluid is prevented by way of the independent valves 140*d*, 156, 142*c*, 158 in the assembly 116 in the upstanding portion 110 despite no additional check valve is provided in the floor cleaning portion 104 is needed. With this configuration, the assembly 116 can thus be made to be more compact and installation of the assembly 116 to the rest of the apparatus 102 from an industrial engineering point of view is technically more efficient.

In the above embodiment, the assembly 116 generally assumes the three-cylinder arrangement with partitions (e.g. the top cap 148, the middle cap 138, etc.) and the chambers (e.g. the chambers 150, 152, 154, 160, etc.) arranged adjacent each other. The three-cylinder arrangement is formed into a larger cylindrical configuration. However, the present invention encompasses alternative embodiments. For example, the three chambers 152, 154, 160 can be arranged in a radial configuration. As a further example, the three chambers 152, 154, 160 can be arranged linearly or in a V-shaped manner. Further, other alternative embodiments are possible when only two liquid cylinders (operable by one motor) are needed, when only one liquid cylinder and one air/gas cylinder (operable by one motor) are needed, and/or when three liquid cylinders are needed.

In the above embodiment, the wobbleable plate 146 acts as a pivotably movable actuator on the plungers 130, 132, 134. In alternative embodiments, other forms of actuator for providing reciprocating or vibratable motion to the plungers 130, 132 driven by the motor 126 will also work.

In the above embodiments, the plungers 130, 132, 134 act as diagram pumps to effect the fluid and air/gas flow. It is envisaged that other types of diagram pumps or pumps would equally work.

FIGS. 13A-13B show that the chamber 150 is situated above the chambers 152, 154. However, in other embodiments, the chamber 150, for example, may be situated at an adjacent side of the chambers 152, 154.

It should be understood that certain features of the invention, which are, for clarity, described in the content of separate embodiments, may be provided in combination in a single embodiment. Conversely, various features of the invention which are, for brevity, described in the content of a single embodiment, may be provided separately or in any appropriate sub-combinations. It is to be noted that certain features of the embodiments are illustrated by way of non-limiting examples. For example, an arrangement with two sealed liquid containers and two fluid cylinders, respectively, both operable by one motor may be provided such that two streams of different fluids can be delivered and then combined to form a formulation therefrom for discharge.

The invention claimed is:

1. A floor cleaning apparatus comprising a cleaning head portion for engaging a floor surface during cleaning, an upstanding portion for maneuvering movement of said cleaning head portion, a liquid delivery assembly, a handle portion extending from said upstanding portion and a sealed liquid storage container, wherein said cleaning head portion includes a first nozzle and a second nozzle arranged on lateral opposite ends for forward discharging of cleaning detergent therefrom, wherein said liquid delivery assembly includes:

a first chamber, a first pipeline allowing fluid communication between said sealed liquid storage container and said first chamber, a second chamber situated adjacent said first chamber, a first conduit allowing liquid to exit from said second chamber to said first nozzle for discharge, a third chamber situated adjacent said first chamber, a second pipeline allowing gaseous communication between said third chamber and said sealed liquid storage container, an inlet allowing surrounding air or gas to enter said third chamber and then said liquid storage container, a fourth chamber situated adjacent said first chamber, and a second conduit allowing liquid to exit from said fourth chamber to said second nozzle for discharge, wherein:

a. said first chamber is provided with a first aperture for fluid communication with said second chamber, said first aperture is reciprocatingly closable by a first one-way valve, b. said first chamber is provided with a second aperture for fluid communication with said fourth chamber, wherein said second aperture is reciprocatingly closable by a second one-way valve, and c. said second chamber and said fourth chamber are provided with a third one-way valve and a fourth one-way valve, respectively, for separately controlling flow of liquid to said first conduit and said second conduit, respectively.

2. A floor cleaning apparatus as claimed in claim 1, wherein said second chamber and said fourth chamber are provided with a first spring-loaded valve and a second spring-loaded valve, respectively, for minimizing liquid leakage from said first conduit and said second conduit, respectively.

3. A floor cleaning apparatus as claimed in claim 1, wherein said second chamber and said fourth chamber are provided with a first plunger and a second plunger, respectively, operable by one motor for pumping fluid from said sealed liquid container to said first and second nozzles, respectively, for discharge.

4. A floor cleaning apparatus as claimed in claim 3, wherein said third chamber is provided with a third plunger operable by said one motor for pumping surrounding air or gas via said inlet to the said third chamber and then via said second pipeline to said sealed liquid storage container for equalizing pressure in said sealed liquid container.

5. A floor cleaning apparatus as claimed in claim 1, wherein said third chamber is provided with a fifth one-way valve for controlling entry of surrounding air or gas to said third chamber, and a sixth one-way value for controlling passage of the air or gas from said third chamber to said sealed liquid storage container, for equalizing pressure in the liquid storage container.

6. A floor cleaning apparatus as claimed in claim 4, wherein said liquid delivery assembly includes a fifth chamber housing said first, second and third plungers and said one motor, and wherein said fifth chamber includes a pivotable plate movable by said one motor and for actuating on said first, second and third plungers alternatingly, thus generating a pumping action.

7. A floor cleaning apparatus as claimed in claim 1, wherein said cleaning head portion is free of any check valve for controlling leakage of liquid from said first nozzle and/or said second nozzle when said floor cleaning apparatus is not in use.

8. A liquid delivery assembly for controlling flow of liquid from a sealed liquid storage container to a first nozzle, comprising:

a first chamber, a first pipeline allowing fluid communication between the sealed liquid storage container and said first chamber, a second chamber situated adjacent said first chamber, a first conduit allowing liquid to exit from said second chamber for the first nozzle for discharge, a third chamber situated adjacent said first chamber, a second pipeline allowing gaseous communication between said third chamber and the sealed liquid storage container, and an inlet allowing surrounding air or gas to enter said third chamber and then the liquid storage container, wherein:

a. said first chamber is provided with a first aperture allowing fluid communication with said second chamber, and said first aperture is reciprocatingly closable by a first one-way valve, b. said second chamber is provided with a second aperture reciprocatingly closable by a second one-way valve for controlling flow of fluid to the first nozzle, c. said second chamber is provided with a first plunger operable by one motor for pumping fluid from the sealed liquid storage container to said first chamber via said first pipeline, then to said second chamber via said first aperture, then via said second aperture, and d. said third chamber is provided with a second plunger operable by said one motor for pumping surrounding air or gas via said inlet to said third chamber and then via said second pipeline to the sealed liquid storage container for equalizing pressure in the sealed liquid container.

9. An assembly as claimed in claim 8, wherein said second chamber is provided with a first sub-chamber extended therefrom, and wherein said first sub-chamber is provided with a third aperture reciprocatingly closable by a first spring-loaded valve for minimizing liquid leakage from said first conduit.

10. An assembly as claimed in claim 8, wherein said third chamber is provided with a third one-way valve for controlling entry of surrounding air or gas to said third chamber, and a fourth one-way valve for controlling passage of air or gas from said third chamber to the sealed liquid storage container, for equalizing pressure in the liquid storage container.

11. An assembly as claimed in claim 8, comprising:

a fourth chamber situated adjacent said first chamber, and a second conduit allowing liquid to exit from said fourth chamber for a second nozzle, wherein:

a. said first chamber is provided with a fourth aperture allowing fluid communication with said fourth chamber, and said fourth aperture is reciprocatingly closable by a fifth one-way valve, b. said fourth chamber is provided with a fifth aperture reciprocatingly closable by a sixth one-way valve for controlling flow of fluid to the second nozzle, c. said fourth chamber is provided with a second sub-chamber extended therefrom, and said second sub-chamber is provided with a sixth aperture closable by a second spring-loaded valve for minimizing liquid leakage from said second conduit, and d. said fourth chamber is provided with a third plunger operable by said one motor for pumping fluid from the liquid storage container to said first chamber via said first pipeline for the second nozzle.

12. An assembly as claimed in claim 11, comprising a fifth chamber housing said first, second and third plungers and said one motor, said fifth chamber includes a pivotable plate drivenable by said one motor and for actuating on said first, second and third plungers alternatingly, for generating a pumping action.

13. An assembly as claimed in claim 11, wherein said first and fifth one-way valves are configured to allow one-way fluid flow from said first chamber to said second chamber and said first chamber to said fourth chamber, respectively.

14. A floor cleaning apparatus comprising a cleaning head portion for engaging a floor surface during cleaning, an upstanding portion for maneuvering movement of said cleaning head portion, a liquid delivery assembly as claimed in claim 11, a handle portion extending from said upstanding portion, and said sealed liquid container, wherein said cleaning head portion includes said first nozzle and said second nozzle arranged on lateral opposite ends for forward discharging cleaning detergent therefrom.

15. A floor cleaning apparatus as claimed in claim 14, wherein, sequentially, said sealed liquid storage container, said first pipeline, said first chamber, said second chamber, said first conduit, and said first nozzle together define a liquid flow path.

16. A floor cleaning apparatus as claimed in claim 14, wherein, sequentially, said sealed liquid storage container, said first pipeline, said first chamber, said fourth chamber, said second conduit, and said second nozzle together define a liquid flow path.

17. A floor cleaning apparatus as claimed in claim 14, wherein, sequentially, surrounding air or gas, said inlet, said third chamber, said second pipeline and said sealed liquid storage container together define a gas flow path.

18. A floor cleaning apparatus as claimed in claim 14, wherein said cleaning head portion is free of any check valve for controlling leakage of liquid from said first nozzle when said floor cleaning apparatus is not in use.

* * * * *